US005138823A

United States Patent [19]

Hartmann et al.

[11] Patent Number: 5,138,823

[45] Date of Patent: Aug. 18, 1992

[54] INSERTION DEVICE FOR INTRODUCING FOIL-LIKE MATERIAL BETWEEN SLICES CUT BY A CUTTING MACHINE

[75] Inventors: Franz Hartmann, Weiler; Roland Zeuschner, Hergatz, both of Fed. Rep. of Germany

[73] Assignee: Natec, Reich, Summer GmbH & Co. KG, Oppenbach, Fed. Rep. of Germany

[21] Appl. No.: 708,059

[22] Filed: May 30, 1991

[30] Foreign Application Priority Data

Apr. 16, 1991 [DE] Fed. Rep. of Germany ... 9104580[U]

[51] Int. Cl.[5] ..... B65B 61/20; B65B 61/08; B65B 63/00; B26D 7/06

[52] U.S. Cl. ..... 53/520; 53/157; 53/389.3; 53/389.4; 83/277

[58] Field of Search ..... 53/157, 389.5, 389.4, 53/389.3, 517, 519, 520; 83/249, 271, 436, 733, 734, 277

[56] References Cited

U.S. PATENT DOCUMENTS

| | | | |
|---|---|---|---|
| 3,019,578 | 2/1962 | Cohen | 53/157 X |
| 4,080,855 | 3/1978 | De George et al. | 83/277 X |
| 4,080,858 | 3/1978 | Stolzer | 83/277 X |
| 4,525,977 | 7/1985 | Matt | 53/550 X |
| 4,583,435 | 4/1986 | Fessler | 83/277 X |
| 4,644,729 | 2/1987 | Fessler | 53/157 |
| 4,774,796 | 10/1988 | Aiuola et al. | 53/389.5 X |

*Primary Examiner*—Horace M. Culver
*Attorney, Agent, or Firm*—Brown, Martin, Haller & McClain

[57] ABSTRACT

An insertion device is used to introduce foil-like material, in particular paper or synthetic segments, between the slices cut by a cutting machine. Such slices are produced in particular in the food industry in the form of sausage, cheese or other food slices with cutting machines. In the insertion device a paper path is unwound from a paper roller and is carried into the cutting range of the circular knife of the cutting machine through an intermittently driven feed device. The insertion device of the cutting machine is arraged on the machine frame so that it can be moved and secured in order to be able to readily clean the insertion device and also to make the corresponding intake area of the cutting machine readily accessible.

7 Claims, 3 Drawing Sheets

INSERTION DEVICE FOR INTRODUCING FOIL-LIKE MATERIAL BETWEEN SLICES CUT BY A CUTTING MACHINE

BACKGROUND OF THE INVENTION

The present innovation concerns an insertion device serving to introduce paper sheets or foil sheets at exact and preset intervals into the intake area of a cutting machine so that these paper or foil sheets wind up exactly between two adjacent slices cut by the cutting machine. In other words, purpose of the paper or foil sheet fed into the area of the cutting machine by the insertion device is to prevent the adherence of two slices placed above one another. Such slices are produced primarily when cutting cheese, sausage or other foods. It is customary to transport either paper sheets or foil sheets into the cutting machine through the insertion device.

An insertion device of the type mentioned above is described in U.S. Pat. No. 4,644,729. At a relatively low speed of 500 sheets per minute, it introduces appropriate paper sheets into the area of the cutting machine and ensures that these paper sheets wind up exactly between two successively cut slices. The disadvantage of this known insertion device however was that it was relatively bulky and that in addition it did not operate autonomously with regard to the main gear of the cutting machine. Indeed, the familiar insertion device had the disadvantage that it required two drive lines as drive for the paper roll and as advance drive for the corresponding feed mechanism, whereby both drive lines were coupled mechanically to the main gear of the cutting machine.

The resulting disadvantage was that the insertion device was fixed to the cutting machine and could not be removed for cleaning purposes. In fact, any removal was possible only at great mechanical expense.

In addition, the familiar insertion device made it necessary to activate pneumatically various drive and control elements, which required great expense due to the separate pneumatic lines. In addition, there was the disadvantage that due to the fully mechanical drive of the familiar insertion, derived from the main gear of the cutting machine, and due to the necessity of a few pneumatic drive and control elements, the familiar insertion device operated relatively slowly, and, as mentioned earlier, required a great deal of space.

Also, the precision of the familiar insertion device left a great deal to be desired because the return accuracy was not exactly adjustable due to the supply of the control elements with air.

SUMMARY OF THE INVENTION

The task of the present innovation therefore is to develop an insertion device of the type mentioned earlier with compact housing and high speed so that it is readily removable from the cutting machine.

To solve the problem, the present innovation enables the insertion device to be movable and lockable at the machine frame of the cutting machine.

In other words, the essential feature of the present invention is that the insertion device is no longer coupled mechanically to the cutting machine but features a corresponding autonomous drive so that it can be readily moved and secured to the machine frame of the cutting machine. As a result, the corresponding mechanical drive lines between the insertion device and the cutting machine become superfluous in accordance with the invention, and are replaced by at least one autonomous drive assigned to the insertion device.

In terms of the functioning of the present innovation, reference is made to the older patent of the same owner, U.S. Pat. No. 4,644,729. The full content of this disclosure is incorporated herein by reference.

With the arrangement of at least one autonomous drive for the insertion device there is the advantage that the unit becomes significantly more compact and requires less space, and in addition that it is arranged movable and lockable at the cutting machine so that such an insertion device can be readily moved or even removed when the cutting machine is to be cleaned or is to be made accessible for repair on the intake side.

In addition, in accordance with the present innovation, a corresponding pneumatic drive for the drive and control units also becomes superfluous thus also reducing the design and manufacturing effort.

In the version of an insertion device featuring a feed belt and realizing the technical theory of claim 1, the feed belt is arranged on the insertion device so that it can be rotated in order to allow the insertion device to move with regard to the cutting machine. Normally (in operation), the feed belt extends into the operation area of the cutting machine. If the insertion device is to be moved, the feed belt must be swung out of this operation area. The insertion device can then be moved on the machine frame of the cutting machine.

The modular design described above signifies that the insertion device operates as an independent unit and has its own drive so that this unit is easily exchangeable. In many applications, paper or foil intake when the cutting machine is in operation is not required. For this application, it is possible to simply remove the entire insertion device from the machine frame of the cutting machine. Another significant feature of the present innovation is that a single motor is used for driving all elements in the insertion device. Over a corresponding ratchet belt, the motor drives the intake roller as well as the first roller of the feed belt. As a result, the paper or foil roller is driven by this motor only indirectly when the intake roller 16 feeds the paper which is unwound through the corresponding pull of the paper or foil roller.

The use of a single drive motor also offers the advantage of a compact housing, which eliminates high manufacturing costs from this perspective as well.

The object of the invention of the present innovation is not only derived from the object of the individual claims, it is also the result of the combination of the various individual claims among one another. All data and features disclosed in the documentation, including the abstract, in particular the design as shown in the drawings, are claimed as essential components of the innovation to the extent that they are new, jointly or severally, in terms of state of the art.

BRIEF DESCRIPTION OF THE DRAWINGS

The following describes in greater detail the innovation through drawings illustrating only one variant. In this regard, the drawings and their descriptions disclose additional features and advantages of the innovation which are essential to the invention.

DESCRIPTION OF THE PREFERRED EMBODIMENT(S)

Figure 1:
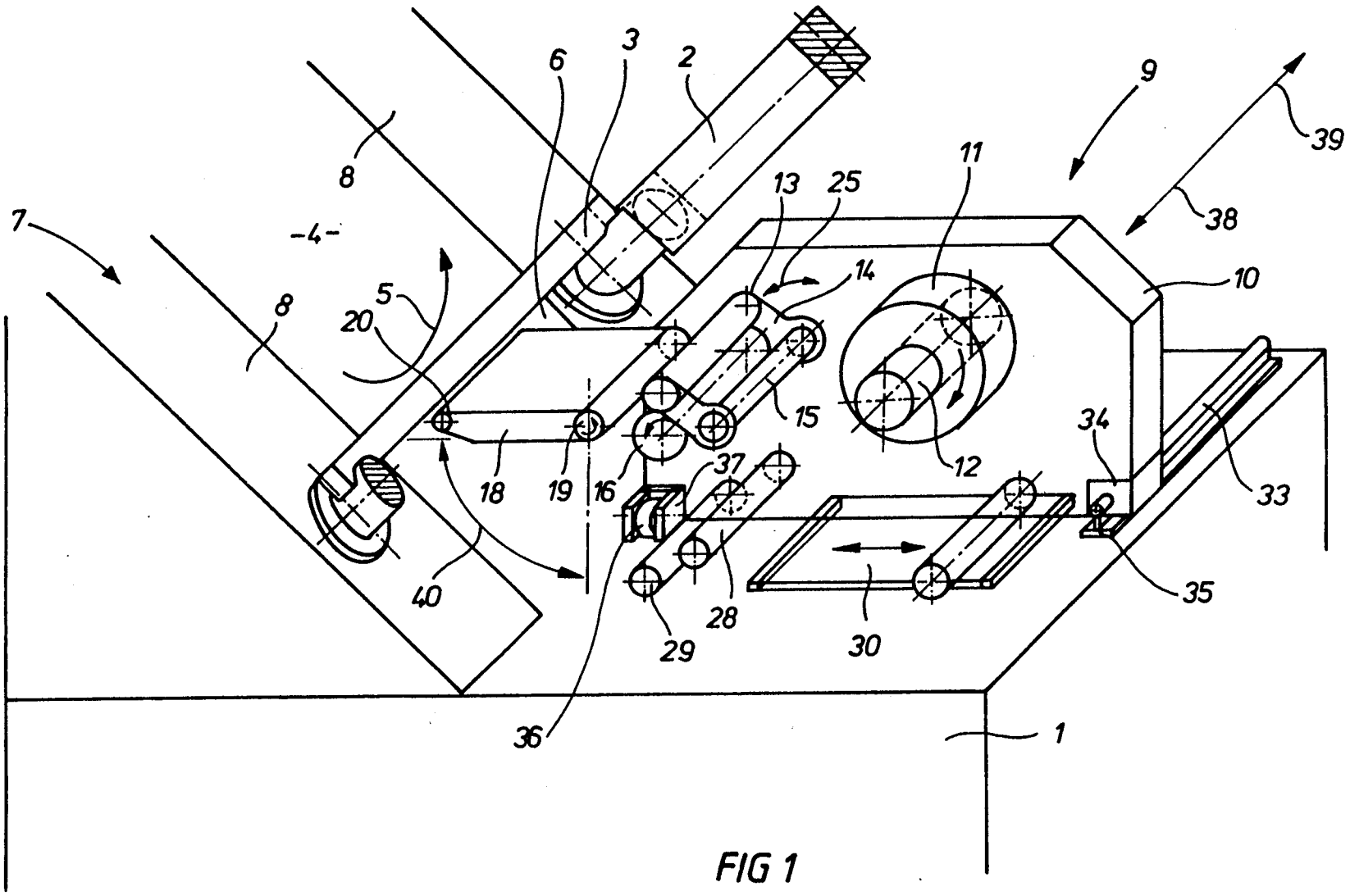
FIG. 1 shows a perspective lateral view of the insertion device in its operating position on a cutting machine.

The insertion device 9 is arranged on the machine frame 1 of a cutting machine 7 so that it is movable. On a horizontal surface of the machine frame 1 a linear guide 5 consists essentially of a flat track which is secured to the machine frame 1 and which carries a guide rail 33 incorporated in a guide housing 34 of the insertion device 9. The guide housing 34 carries ball bearings not shown and can therefore be moved along the guide rail 33 in the direction of arrows 38, 39.

The front of the housing 10 of the insertion device 9 is movable on the machine frame 1 in that each side of the housing 10 has a rotating track-supporting roller 36 which is held in a bearing block 37.

The fixation device is not shown in greater detail and is arranged between the housing 10 of the insertion device and the assigned guide rail 33. This fixation device could consist of a locking pin engaging corresponding index bores of the guide rail 33.

In another variant of the present invention the fixation device may consist of a clamping bolt screwed into a threaded nut in the housing 10 and which with its bolt-side end can be pressed onto the guide rail 33.

In essence the insertion device 9 consists of a receptacle 12 which accommodates a rotating paper roller 11. It has been mentioned already that a foil roller may be used instead of a paper roller 11. For clarity sake, it is assumed below that a paper roller 11 is used.

Figure 2:
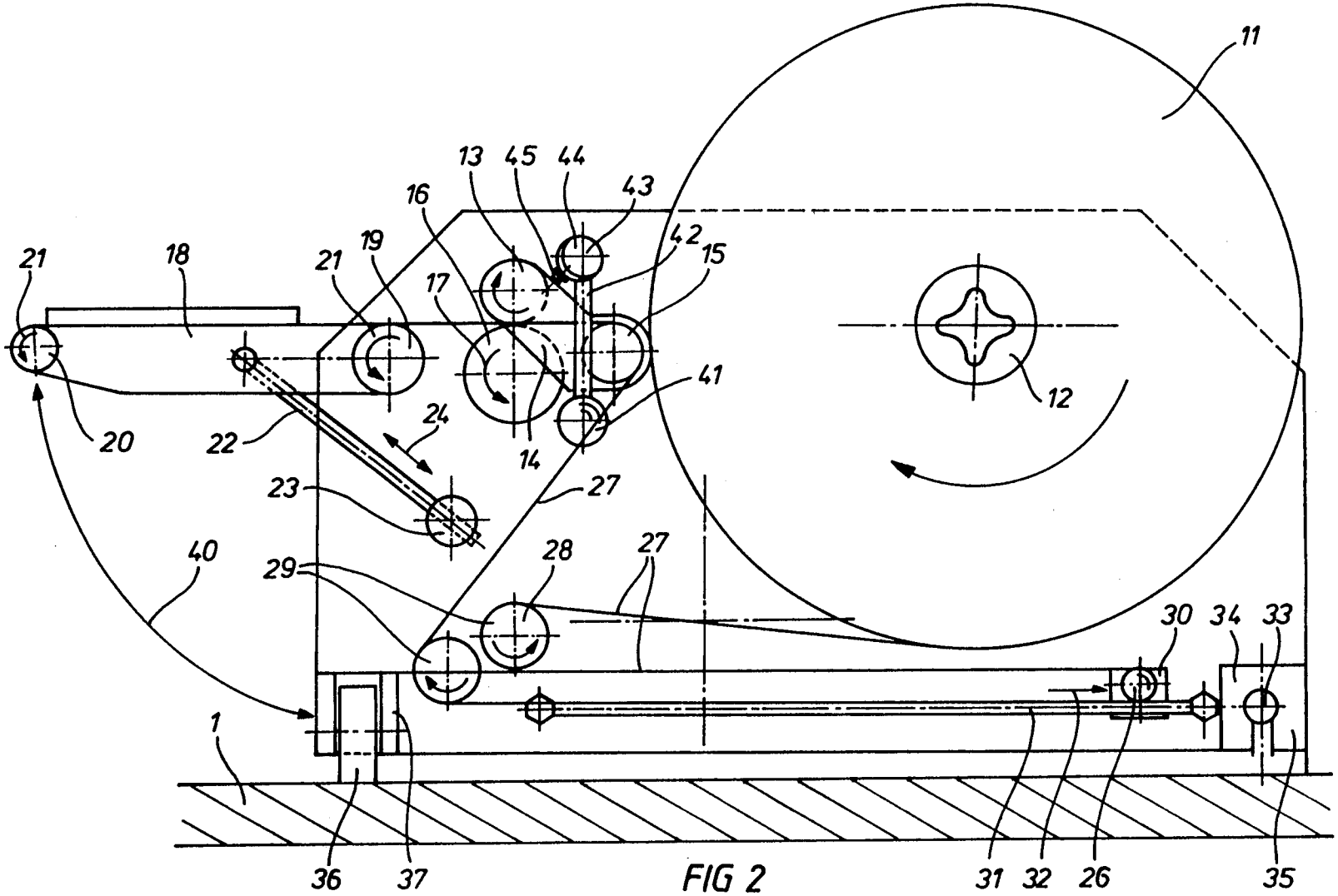
FIG. 2 shows the lateral view of the insertion device.

In accordance with FIG. 2, the paper path 27 is wound over a first guide roller 28 before reaching a jumping roller 26. The jumping roller 26 can be rotated and is arranged on a carriage 30 which in turn can be moved along a guide rail 31. Through spring tension in the direction of the arrow 32, the carriage 30 is prestressed in the direction of the arrow 32 so that the paper paths 27 are always prestressed in the direction of the arrow 32.

After looping of the jumping roller 26 the paper path 27 runs over another guide roller 29 over an axis 15, and after looping of this axis 15 the paper path 27 runs into the roller clearance between an intake roller 16 and an opposite pressure roller 13.

The paper path then reaches a feed belt 18 which features a series of parallel cord belts guided over a roller 19 on the feed side and a roller 20 on the exit side.

The entire feed belt 18 can be moved in the direction of the arrows 40. Its rotatability is due to the fact that in the distance to the center of rotation of the feed belt on the housing 10 of the insertion device there is a supporting rod 22 at the feed 18 which can be adjusted in the direction of the arrow 24 and is held in a locking bolt 23 at the housing 10 of the insertion device 9.

In other words, the supporting rod 22 can be adjusted in its length in the direction of the arrows 24 by loosening and securing the locking bolt 23.

Figure 3:
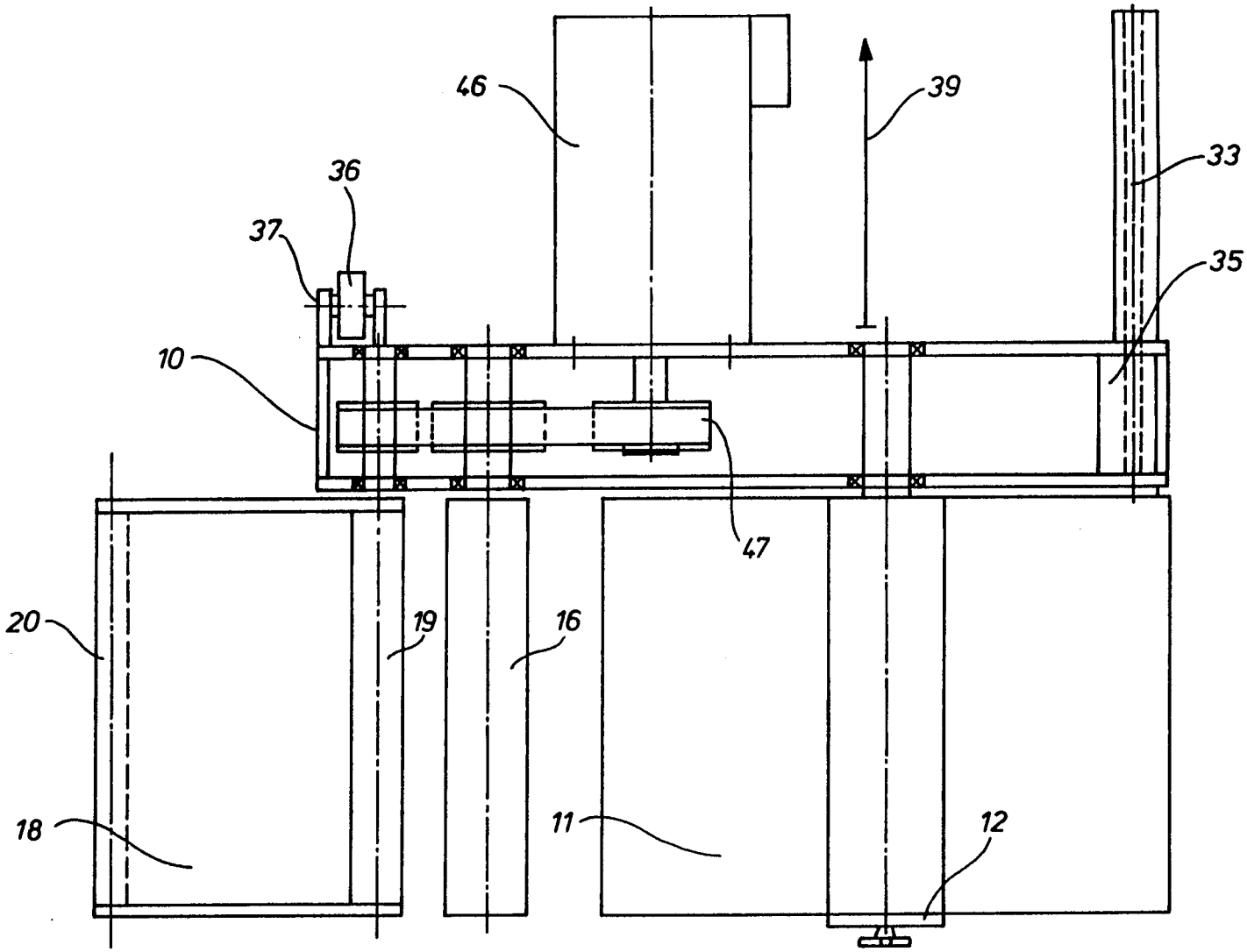
FIG. 3 shows the top view of the insertion device in accordance with FIG. 2.

In accordance with FIG. 3, the drive of the drive elements of the insertion device 9 occurs over a single motor 46, which through its drive shaft and a corresponding drive gear drives a ratchet belt 47 which in turn drives the intake roller 16 and the feed-side roller 19 of the feed belt 18 through corresponding drive gears.

FIG. 3 does not show that there is an additional tension roller for the ratchet belt 47 in order to guarantee a force-locking and form-locking drive of the intake roller 16 and the succeeding roller 19.

The roller 19 is driven in the direction of arrow 21 just like in the same direction the intake roller 16 is driven in the direction of the arrow 17.

The pressure on the paper path 27 in the roller clearance between the intake roller 16 and the pressure roller 13 can be set because the pressure roller 13 is arranged on the free, rotatable portion of a lever pair 14 which can be rotated and is arranged on the axis 15.

Pressure of the lever pair 14 and thus of the pressure roller 13 on the intake roller 16 is the result of the fact that in a housing-locked point of rotation 43 a lever 42 can be rotated which features a grip 41 on its free front end.

In the point of rotation 43 an eccentric shaft 44 is connected to the lever 42 whereby the outer perimeter of the eccentric shaft 44 bears upon the pressure roller 13 through a spring pressure bolt 45.

In other words, in the operating position as shown in FIG. 2 the spring pressure bolt 45 puts consistent pressure on the pressure roller 13.

In order to introduce the paper into the roller clearance between rollers 13, 16, the grip 41 is rotated 180° by hand whereby the pressure of the eccentric shaft 44 on the spring pressure bolt 45 disappears and whereby a larger roller clearance is created between the rollers 13, 16.

The paper path 27 can now easily be introduced into this enlarged roller clearance. The lever 42 with the grip 41 is then returned to the position shown in FIG. 2.

The set-up of the insertion device 9 on the cutting machine 7 can easily be changed. In essence the cutting machine 7 consists of a support 8 in whose intermediate area the circular knife 4 operates. Across from the circular knife 4 is a fixed knife bar 3 whereby product is fed over the insertion device 9 and whereby a support 2 supports the product supply mechanism.

The circular knife 4 operates in the direction of the arrow 5, and underneath the knife bar 3 is a recess 6 in the machine frame 1 of the cutting machine 7 into which the insertion device 9 threads its paper path 27.

In order to bring sensitive parts of the insertion device 9 outside the cutting range of the cutting machine 7 (otherwise cutting waste could wind up into the insertion device 9), there is a feed belt 18, which could be deleted in other variants.

It is important that the entire housing 10 of the insertion device 9 can now be moved in a simple manner along the machine frame 1 in the direction of the arrows 38, 39. Now that it has its own autonomous drive no longer derived from the drive of the cutting machine 7, moving is accomplished by simply rotating the feed belt 18 downward in the direction of the arrow 40 and to loosen the corresponding fixation device whereby now the entire housing 10 can be moved to the right in the direction of the arrow 39. As a result, the recess 6 on the cutting machine 7 is now readily accessible and can easily be cleaned and serviced.

A single motor which intermittently drives the intake roller 16 and the feed-side roller 19 of the feed belt 18 in exact set intervals produces an accurate guidance of the paper path with exactly and intermittently fed paper segments which are then cut by the circular knife 4.

Electronic control of the motor 46 through corresponding digital control ensures consistently the same paper length and the entire insertion device is able to operate with significantly higher speeds of for example 600 to 800 sheets per minute.

In addition, a very short overall length is achieved in part because there is only a single tip mechanism consisting of the lever pair 14 and the pressure roller 13 while familiar insertion devices require two such tip mechanisms.

A greater processing speed is also achieved due to the fact that because of a single motor only a relatively small mass must be moved intermittently. Known insertion devices required two drive lines, and larger masses needed to be moved.

Although a preferred embodiment of the invention has been described above by way of example only, it will be understood by those skilled in the field that modifications may be made to the disclosed embodiment(s) without departing from the scope of the invention, which is defined by the appended claims.

We claim:

1. An insertion device for intermittently feeding a foil-like web of paper or synthetic sheet material into the cutting path of a cutting blade of a cutting machine, comprising:

a support housing;

a paper roller rotatably mounted on the housing;

guide means defining a paper path from the paper roller into the cutting path of a cutting blade of a cutting machine;

feed means for driving paper along the paper path;

intermittent drive means for driving the feed means; and adjustable mounting means for adjustably and removably mounting said support housing on the machine frame of a cutting machine; and securing means for securing the support housing in a selected position on the machine frame.

2. The insertion device as claimed in claim 1, wherein said adjustable mounting means comprises means for moving the support housing in a direction perpendicular to the paper path.

3. The insertion device as claimed in claim 1, wherein said adjustable mounting means comprises an elongate guide rail for mounting on a flat support surface of a cutting machine frame, and said housing includes slider means for slidably engaging said guide rail for movement along said rail.

4. The insertion device as claimed in claim 3, wherein said slider means is provided at one end of the housing, and support rollers are rotatably mounted at the opposite end of the housing in an orientation corresponding to the direction of travel along said guide rail for engaging said support surface to support said housing as it travels along said guide rail.

5. The insertion device as claimed in claim 1, wherein said drive means comprises an autonomous drive independent of the cutting machine drive.

6. The insertion device as claimed in claim 1, including a feed belt having opposite inlet and outlet ends, the inlet end being rotatably mounted on said housing and the outlet end comprising means for projecting forwardly into the cutting range of a cutting blade of a cutting machine.

7. The insertion device as claimed in claim 6, wherein said guide means includes rotatable guide rollers along said paper path, said feed means including a feed roller in said paper path, and a pair of spaced, belt guiding rollers around which said feed belt extends, and said drive means comprises a motor operatively connected to said feed roller and to one of the belt guiding rollers.

* * * * *